United States Patent [19]

Palmer et al.

[11] 4,314,776

[45] Feb. 9, 1982

[54] OFFSHORE DRILLING AND PRODUCTION STRUCTURE

[75] Inventors: Harry E. Palmer; David G. C. Stenning, both of Calgary, Canada; Ray K. Crockett, Perth, Australia

[73] Assignee: Dome Petroleum Limited, Calgary, Canada

[21] Appl. No.: 50,607

[22] Filed: Jun. 21, 1979

[30] Foreign Application Priority Data

Jun. 21, 1978 [CA] Canada ..... 305916

[51] Int. Cl.[3] ..... E02D 23/02

[52] U.S. Cl. ..... 405/205; 405/203

[58] Field of Search ..... 405/203–209, 405/217, 196–200; 114/264

[56] References Cited

U.S. PATENT DOCUMENTS

| | | | |
|---|---|---|---|
| 2,970,446 | 2/1961 | Suderow | 405/203 X |
| 3,412,564 | 11/1968 | McClintock | 405/208 |
| 3,698,198 | 10/1972 | Phelps | 405/204 |
| 3,754,403 | 8/1973 | Mott et al. | 405/208 X |
| 4,002,038 | 1/1977 | Phares et al. | 405/203 X |
| 4,155,671 | 5/1979 | Vos | 405/203 |

FOREIGN PATENT DOCUMENTS

| | | | |
|---|---|---|---|
| 1430084 | 3/1976 | United Kingdom | 405/207 |

*Primary Examiner*—Dennis L. Taylor

*Attorney, Agent, or Firm*—William R. Hinds

[57] ABSTRACT

The invention relates to an off-shore marine structure that provides an elevated support for a drilling and/or production platform. A structure comprised of three interlocking components is provided, the first component being a large foundation base installed on the sea bed; the second being a conical shaped support component which is engagable with the foundation base and which, releasably carries the third platform supporting component. In the preferred form, the platform supporting component comprises a centrally-disposed vertical column, means being provided to facilitate engagement of the column with the platform and the second component and to subsequently elevate the platform to an operating height above sea level.

14 Claims, 7 Drawing Figures

OFFSHORE DRILLING AND PRODUCTION STRUCTURE

BACKGROUND OF THE INVENTION

The invention relates to off-shore drilling and production structures, particularly, but not exclusively for use in Arctic waters, where environmental conditions present severe conditions for oil or gas production.

The southern Arctic ocean, particularly in the ice-shear zone of the continental shelf, in the Beaufort Sea, is the subject of intense investigation in the search for oil and gas resources.

Since ice covers the general area for up to nine months of the year, ice islands, and other large ice masses, such as ice ridges contained within the seasonal pack ice provide formidable obstacles to fixed off short installations. Ice islands, while rare, usually exceed 100 feet in thickness and may cover several square miles in area. Thus, it will be appreciated that the potential impact of ice on any sub-sea structure has necessitated the design and development of structures adapted to withstand what could be considered normal ice impingement.

There are presently available many different structural arrangements that have been designed with this problem in mind. Examples of such structures are found in U.S. Pat. Nos. 3,793,840 and 3,754,403 issued to Texaco Inc. during 1974; 3,952,527 issued to E. R. Vinieratos et al, in April, 1976 and 4,037,424 to E. O. Anders in July of 1977. Such structures however have numerous practical disadvantages since they, in the main, do not have the structural integrity to withstand the attack of frequently occurring large ice ridges. Furthermore, ice islands, drawing up to one hundred and fifty feet of water would pose intenable loads on any structure in their path. Therefore, there exists a need for a structure that may be simply installed, and capable of withstanding normal ice impingement forces, and further adapted to be quickly and easily dismounted to avoid impact with for example, ice islands or for re-emplacement at a different location.

BRIEF SUMMARY OF THE INVENTION

Accordingly, the invention provides a marine structure comprising three major components. The first component is a large foundation base installed on the sea floor, which will provide a secure foundation for the structure and will contain the production wellhead and manifolding facilities. The upper surface of this foundation component, on one embodiment, would be located a minimum of 150 feet below the water surface. This depth being below the maximum possible depth of damage from an ice island.

The second component is a conical shaped support component which rests on the foundation component and which carries the third component of the structure. The conical support component is fully capable of withstanding all ice forces, except ice islands, on a continuous basis. It has both permanent and variable ballast provisions. In the unlikely, but possible event of approach by a massive ice island which could potentially damage the upper structure, the conical component can be disconnected from the foundation component and allowed to move with the environmental forces or supplemental motive forces supplied by a ship or ice-breaker. The conical component has the unique design provision of disconnection from the foundation component and has capability for de-ballasting to allow passive floating or aided towing out of harms way.

The third component which in one embodiment, may include a combined supporting column and working platform is also preferably detached from the conical supporting component, and provides for a stable design configuration in the floating mode. Another aspect of this feature of removing the third component from the conical support component is that it will allow a deck structure and layout for exploration or production drilling to be interchanged later by a deck especially built complete with production facilities.

In a further embodiment, the supporting column may be formed as a part of the second component, operably associated therewith in a telescopic fashion such that when the second component is interconnected with the first foundation component, the column may be vertically extended from the second component for interconnection with the working platform. While the column may be utilized to affect elevation of the platform to an operating height in either embodiment, in a further aspect of the invention, ancillary jacking devices positioned about the platform may be utilized to affect the primary elevation. Thus, when the platform has attained its operational height above the surface of the body of water by means of these devices, the main supporting column can be locked in position between the platform and the second conical component, and the jacking device retracted for retention by the platform.

BRIEF DESCRIPTION OF THE DRAWINGS

The invention will now be described, by way of example only, reference being had to the accompanying drawings in which.

DETAILED DESCRIPTION OF THE INVENTION

Figure 1:
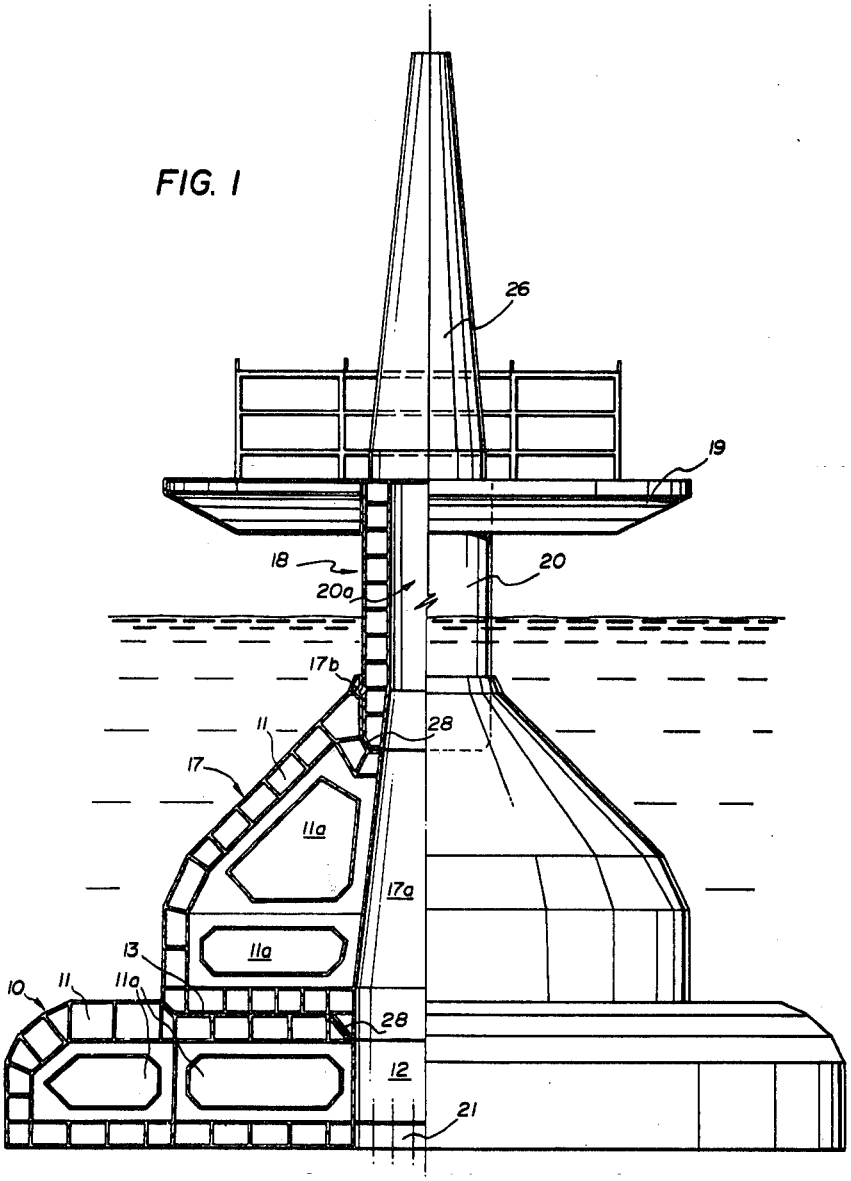
FIG. 1 is a vertical side view, in partial cross-section of a first embodiment of the invention where a three-part inter-locking structure is schematically shown in its operting mode, resting on the sea-bed.
Figure 2:
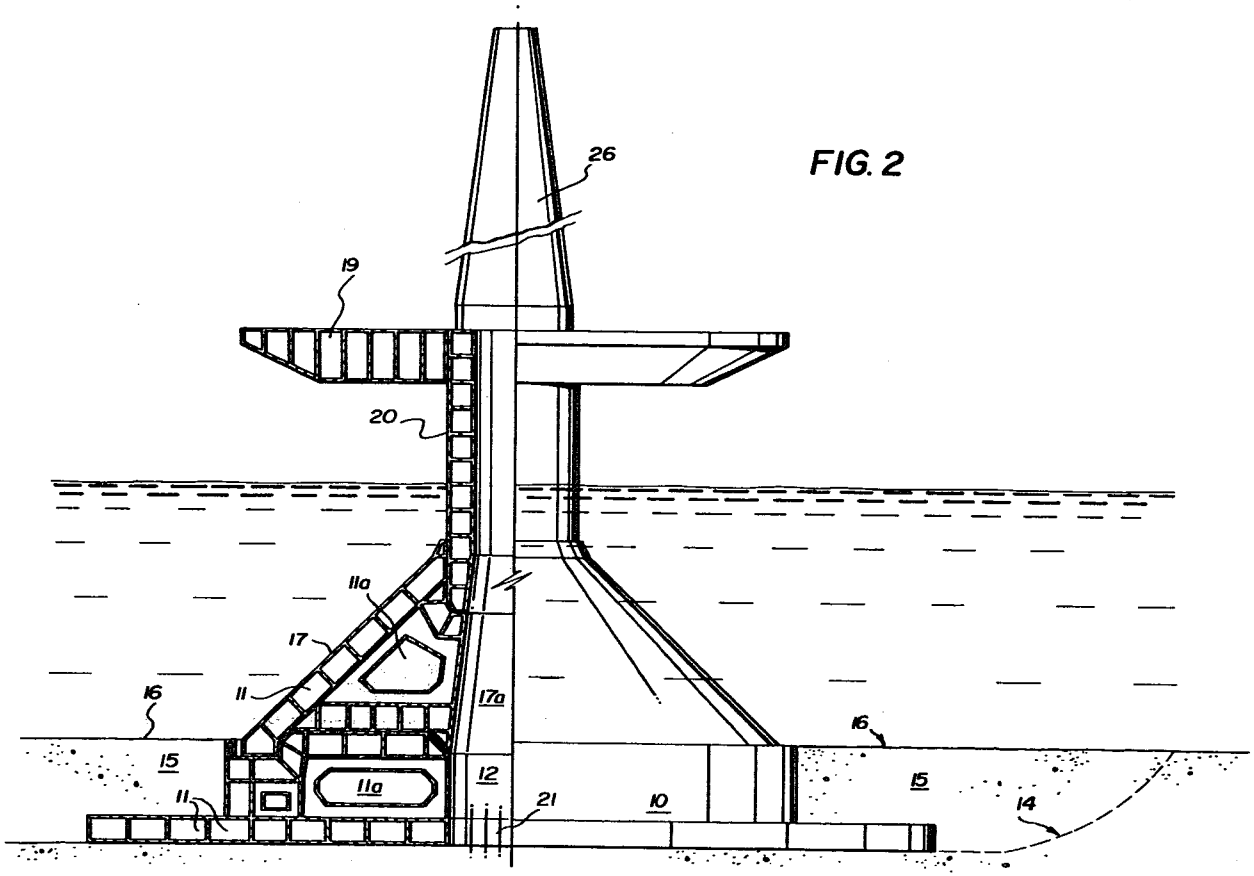
FIG. 2 is an alternative arrangement of the three-part interlocking structure, shown in FIG. 1, for shallow water emplacement.

Referring now to the drawings, wherein like numerals have been utilized to indicate corresponding parts in all figures, it will be seen that the structure according to the invention comprises three major inter-engagable components, which referring to FIGS. 1 and 2, can be seen to comprise a base section 10, an intermediate section 17 and an upper section 18.

Looking firstly at base section 10 of FIG. 1, in this embodiment, the structure is designed to be emplaced on the sea-bed in water depths of 200 feet or more.

Thus, there is shown a base, which in its preferred form is of circular configuration, having an external diameter of between 200–400 feet and vertical thickness of between 40–70 feet. These structure sizes and water depths are only included to give perspective to the concept and therefore are in no way intended to be limiting.

Since it is contemplated that the base 10 will be constructed of high strength concrete, steel, or a combination thereof, the structure will normally be fabricated off-site, floated to the drilling location where it can be submerged, and if required, fixed to the sea bed. Base 10, in the embodiment according to FIG. 1 is compartmented. This compartmentation serves two purposes. Firstly, the compartments 11 and 11(*a*) are adapted to be of a completely enclosed nature to provide the necessary buoyance for towing to site, and it will be appreciated that a complete pressurization system (not shown) may be included, involving remotely actuated pumps, valves and fluid transferral means to permit controlled buoyance to be attained. Secondly, when it is required to submerge the base structure, it is simply necessary to reverse the process and pump water into the compartments, thus converting same into ballast chambers. The larger compartments 11(*a*) could be filled with solid ballast pumped from the sea-bed, or drilling mud, should additional stability be required.

Base 10 is provided with a central vertical opening 12 extending therethrough, which opening bounds the wellhead area. It is anticipated that the base 10 will be required to contain wellhead equipment and pipeline manifolds in, for example, a chamber that may be accessible either through the facility, or through an entry port provided in the base, accessible from for example a submersible craft.

Finally base 10, in its upper surface is provided with a central recess 13, the purpose of which is to accept and engage intermediate section 17, as will be described hereafter.

Since the configuration of base 10 (FIG. 1) is designed to be emplaced in water depths of 200 feet, it is anticipated that no additional anchoring, other than the ballasting mentioned above will be necessary. However, in the embodiment of FIG. 2, there is shown a facility designed for emplacement in relatively shallow coastal areas, where the water depth will be in the region of 140 feet or less. Such installations are, as will be appreciated, more susceptible to ice scouring. Thus, it is envisaged that it will be necessary to embed base structure 10 as shown in FIG. 2. Initially, a "glory hole" 14, shown in phantom outline, will be excavated in the sea-bed to a typical depth of 40 feet. Base 10 will be positioned within this excavation and sand 15 or soil from the sea bottom utilized as ballast in the manner shown. In FIG. 2, the normal sea bottom is indicated by numeral 16.

Returning now to FIG. 1, it can be seen that the intermediate section 17, in its preferred form is a conical structure, this form being chosen since it causes the ice to ride up the slope and break in flexure. The downward vertical force caused by the ice further helps to stabilize the cone against overturning and also increases the normal force on the foundation soil interface, thereby incresing the sliding resistance of the base structure 10. In the configuration according to FIG. 1, a typical cone slope would be 45°, however, as will be understood, this angle could be within a range of 20°–60°, such being determined by considering a number of factors, the most important being the prevailing ice conditions, and the ice forces to which the structure will be subjected.

Intermediate section 17 may be fabricated from high strength concrete, or steel and, in a similar fashion to base structure 10, will be preferably constructed off-site and floated to the drilling location, to be submerged and interconnected with base 10. As can be seen from the drawings, the lower portion of the conical structure is dimensioned such that it will interlock within the recess 13 in base 10, disengagement being possible only in the substantially vertical direction. Like base 10, section 17 is provided with compartments 11 and 11(*a*) which initially serve as buoyancy chambers during transportation of the section to the drilling site, such chambers being thereafter converted to ballast tanks to stabilize the structure in its submerged position.

Again, in similar fashion to base 10, cone structure 17 is provided with a centrally disposed vertical opening 17(*a*) extending therethrough. When sections 10 and 17 are interconnected, openings 12 and 17(*a*) are continuous one with the other to provide an operating chamber or shaft through which access to the wellhead area may be achieved.

Conical section 17 is also provided, within the upper portion of the cone, with a recess 17(*b*) into which the upper section 18 may be interlocked.

In FIG. 2, while the intermediate section 17 is of slightly different configuration to that shown in FIG. 1, the same principles of construction apply. The cone angle is appreciably different to that discussed above with regard to FIG. 1, to accommodate, for example, the ice conditions applicable to the shallow water emplacement of this particular facility. Additionally, a more positive method of interlocking as between sections 10 and 17 may be required, one preferred, but exemplary form is shown in FIG. 2, but is not discussed here in detail since its structural aspects will be self-evident from the drawings.

Finally, there is provided a third upper section 18, which for the purpose of this description, is identically shown in relation to the embodiments of FIGS. 1 and 2.

This section in its preferred form includes, in combination, a deck or operating platform 19 and a vertical support column 20.

Section 18, is in principle similar to a conventional jack-up barge, in that platform 19 constitutes the deck upon which the drilling or production facilities are carried, and the vertical column 20 provides the means by which platform 19 is elevated to its working height above sea level.

Platform or barge 19 is preferably constructed of steel and must be designed to accommodate a load in excess of 10,000 metric tons. The novel features of this platform 19, in this embodiment, are the provision of a centrally disposed supporting column 20, of substantial transverse cross-section, carried by the platform within guide means (not shown), and the subsequent elevation of the barge to its operating height.

Figure 3:
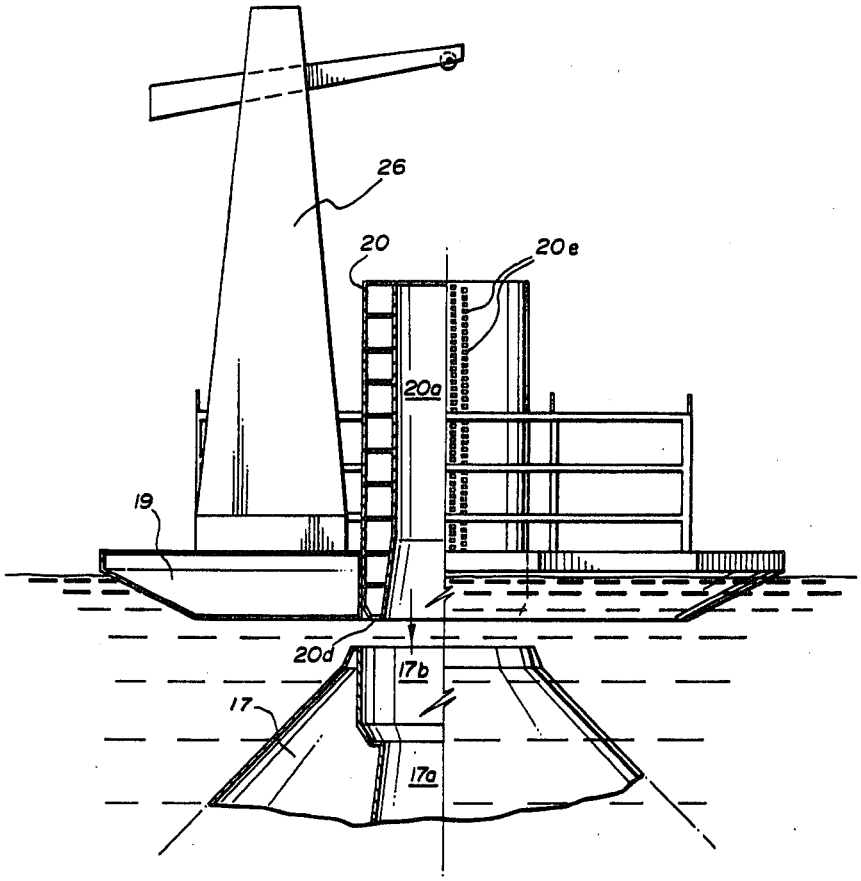
FIG. 3 is a fragmentary side view in partial cross-section of the upper, floating platform which carries the third upper component of the structure, prior to interlocking with the sub-sea structure.
Figure 4:
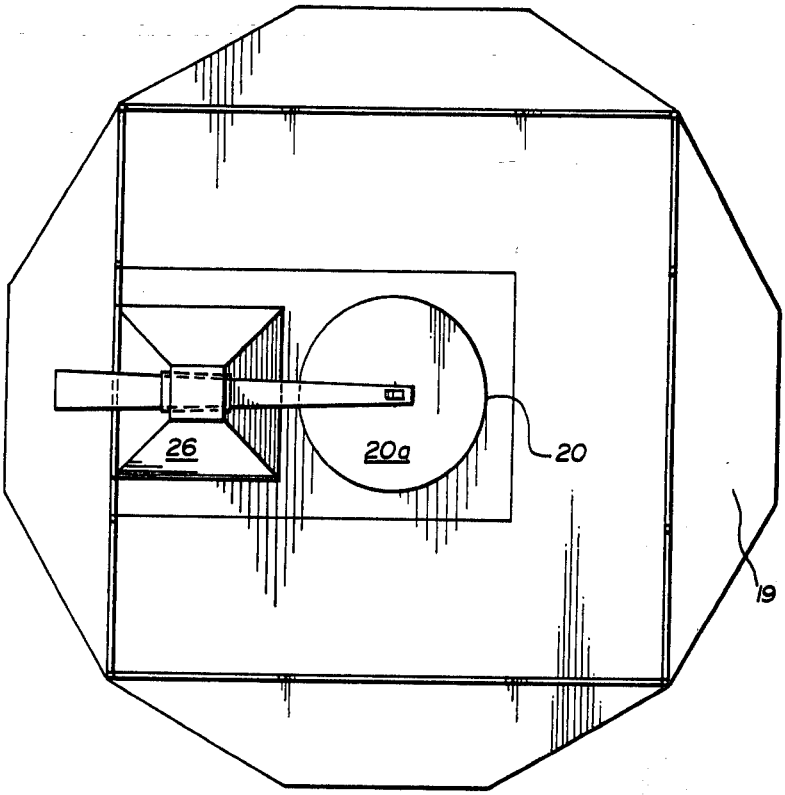
FIG. 4 is a general plan view of the platform according to FIG. 3.

FIG. 3 shows schematically, a barge 19 floating above the sub-sea structure with column 20 in its upper, raised position.

Figure 5:
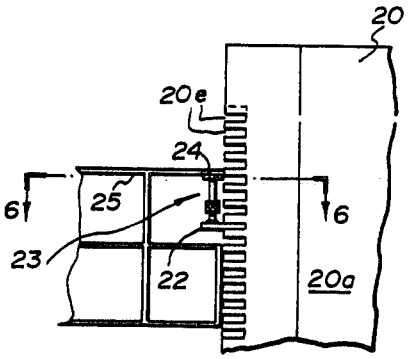
FIG. 5 is an enlarged segmentary view in partial cross-section showing a portion of the structure according to FIG. 3.
Figure 6:
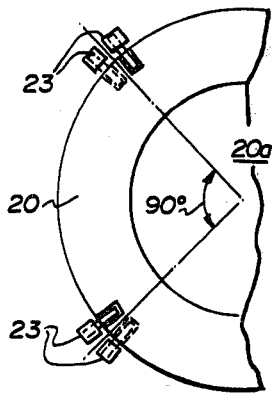
FIG. 6 is a cross-sectional plan view taken along line 6—6 of FIG. 5.

By utilizing a jacking system which will be more particularly described in relation to FIGS. 3, 5 and 6, column 20 is lowered until its end 20(*d*) slots into the recess 17(*b*) provided in the upper portion of section 17. Subsequent jacking will then elevate deck 19 into the fully supported position shown in FIGS. 1 and 2, where the top of column 20 will be subsequently flush with upper surface of deck 19.

As can be seen, column 20 is also provided with a centrally disposed vertical opening 20(*a*) extending therethrough. The diameter of opening 20(*a*) being such, that when section 17 is interconnected with column 20, openings 17(*a*), 20(*a*) and of course 12, are continuous one with the other to form a vertical shaft through the structure.

One form of jacking system is shown and will now be described with reference to FIGS. 3, 5 and 6. It is not however intended to imply that this arrangement is the only possible means to effect elevation of the platform 19 since other jacking systems may be equally applicable.

In this embodiment, column 20 is circular in transverse cross-section; fabricated in steel and compartmented for strengthening purposes. At radially spaced intervals about the outer circumference of column 20, and extending in the longitudinal direction thereof, the column is provided with adjacent and parallel rows of notches 20(*e*), each row of notches being adapted to receive a chock-like element 22, operable in conjunction with a respective hydraulic jack 23. At each spaced location, a pair of jacks 23 are mounted within deck 19, fixedly attached at their upper ends 24 to the undersurface 25 of the deck.

The lower extremity of each jack 23 is adapted to carry a chock element 22.

In operation, the jacks 23 of each pair, are operated alternatively to effect engagement of their respective chock within an adjacent notch, and to subsequently elevate the deck a predetermined distance. It will be appreciated that while one jack of each pair is operational to support and raise the deck, its companion jack is relaxed to enable its chock element to be pivoted out of engagement with its notch for subsequent re-location in a higher notch. Thus, the weight of deck is being automatically transferred from one jack to the other in a programmed fashion until the deck is in its elevated and operable position. Each pair of jacks 23 are obviously required to be operated simultaneously to maintain the deck level at all times.

As previously mentioned, it is preferable that in its upper supported position, the surface of the deck is substantially flush with the top of column 20. This is important since the drilling rig 26 has to be moved into position above the central opening 20(*a*). A track system formed within the upper surface of the deck would serve this purpose.

As has been briefly mentioned, drilling and production is affected through the combined, centrally disposed opening 12, 17(*a*), 20(*a*). With the structure according to the invention, it is envisaged that twenty-four or more wells can be developed. For example, the wells would be drilled at say eight foot centers within a forty foot diameter template 21 (FIG. 1) located within the base 10 on the sea floor. The wellhead equipment and manifolding piping previously mentioned as located within base 10, would deliver through a production riser through section 18 to the deck 19. During drilling, the blowout preventer could be advantageously located within the base.

It will also be appreciated, that the combination opening or shaft provided by bores 12, 17(*a*) and 20(*a*) could be utilized in a completely flooded condition i.e. wet, or means would be provided to maintain the bore "dry" by sealing the structure and evacuating the water. In the latter case, it would be necessary to provide, in the interface between each interlocking structure, some form of seal or sealing compound indicated by numeral 28 on FIG. 1.

While it is envisaged that adequate interlocking will be achieved simply by virtue of the weight of each section, it may be additionally desirable, prticularly as between sections 10 and 17 to provide separate anchoring means such as hydraulic bolts. Should it become essential to affect the release of section 17 from the base 10, such bolts could be provided with explosive heads remotely actuated from the elevated deck.

An additional feature of this invention would be to dimension base 10 to include oil or liquid natural gas storage chambers, and to adapt the deck 19 to facilitate mooring, and the transferral of oil or L.N.G. to a surface vessel.

In the embodiment discussed heretofore, the third upper section 18 is exemplified by a composite structure comprising an operating platform 19 and a sole vertical supporting column 20. The column being initially carried by the platform and adapted to be lowered into operable engagement with the second conical section 17, and utilized subsequently to raise the platform to its operating height.

Figure 7:
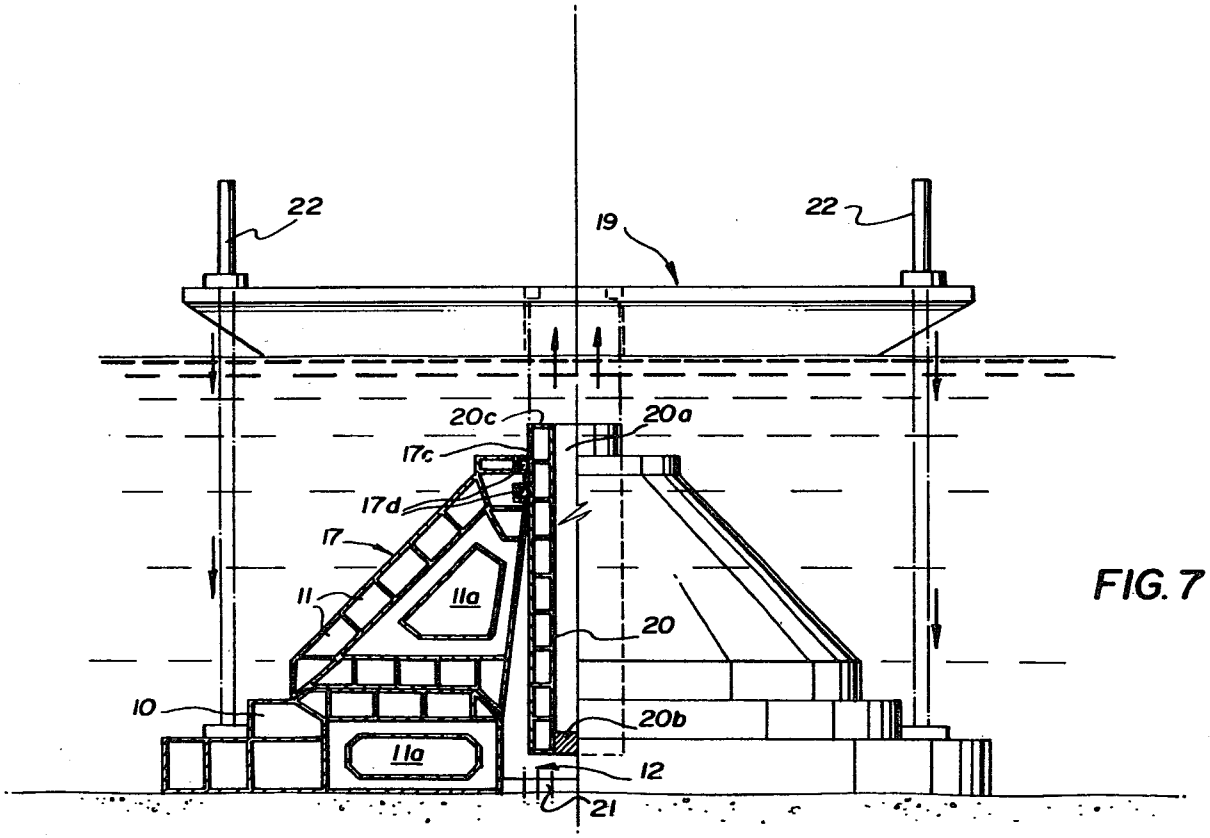
FIG. 7 is a schematical representation of a further embodiment of the invention.

It is however, within the scope of the present invention to include the supporting column as in integral part of section 17 in the manner shown schematically in FIG. 7. Here, column 20 is an extensible component of section 17, slidably contained within the section in a telescopic fashion. Following submergence and coupling of section 17 to base section 10, column 20 is telescopically extended until its upper end 20(*c*) engages and is locked with the floating platform 10. Continued extension of column 20 thereafter lifts platform 19 to its upper, operating position, as shown in phantom outline.

As will be appreciated, vertical movement of column 20 can be achieved by various means, only one method will now be more particularly described hereafter.

Firstly, referring to FIG. 7, it will be necessary to seal opening 20(*a*) at the lower end of column 20 by means of for example, a removable plug or the like indicated at 20(*b*). Chamber 12 can then be pressurized, pressure build-up within the chamber acting on the column in a piston-like fashion to cause the column to move vertically, guided by the upper portion 17(*c*). For this method to be effective, high pressure seals may be required where indicated at 17(*d*), and locking means (not shown) will be necessary to prevent retraction of column 20 when pressure is released.

Since the platform 19 in its fully loaded condition may weigh upwards of 10,000 metric tons, additional ancillary jacking devices may be required to facilitate elevation of the platform to its operating height. Such devices 22, shown in phantom on FIG. 7, would preferably be carried by the platform, and following location of the platform above the sub-sea structure, extended downwardly into engagement with for example, the base component 10. Continual operation of the jacking devices 22 would effect the necessary elevation of the platform. It will then be required to lock column 20 in place between platform 19 and conical component 17, and retract the jacking devices. The weight of the platform will thereafter be supported solely by the column. Should dismantling of the structure become necessary, the process described above can be reversed.

Further modifications and alternative embodiments of the invention will be apparent to those skilled in the art in view of the foregoing description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size and general arrangement of components. For example, equivalent elements may be substituted for those illustrated and described herein, parts may be used independently of the use of other features, all as will be apparent to one skilled in the art after having the benefits of the description of the invention and the appended claims.

We claim:

1. A marine structure adapted to be located offshore in a body of water so as to provide elevated support for a working platform, said structure being of composite construction and comprising:

(1) a first selectively floatable and submergible base section, adapted to be installed on the floor of said body of water;

(2) a second selectively floatable and submergible, substantially conical section constructed and arranged to be locatable on and releasably engagable with said base section, to extend vertically therefrom and to be vertically separable therefrom such that the conical section can be buoyantly elevated and removed independently of said base section and temporarily or permanently, so as to permit removal and transporting of said second section when conditions so dictate, and return of said second section and re-engagement with said base section when desired;

(3) support means adapted to extend substantially vertically between said second section and said platform and to operably interconnect said second section and said platform; and (4) means operably associated with said support means to selectively effect elevation of said platform to a stable position above the surface of said body of water.

2. The structure according to claim 1 wherein said support means comprises a single elongate column of substantial transverse cross-section.

3. The structure according to claim 2 wherein each of said first and second sections, said column, and said platform are provided with a vertical opening extending therethrough, such that a continuous open shaft is formed through said structure.

4. The structure according to claim 3 wherein each of said first and second sections are fabricated to include a plurality of compartments, and means are provided in conjunction with said compartments for regulating the displacement of said first and second sections independently of each other between floating positions and submerged positions.

5. The structure according to claim 4, wherein said base section includes compartments adapted for the containment and storage of hydrocarbons.

6. The structure according to claim 4 wherein the cone-angle of said second section is in the range of 20°–60°.

7. The structure according to claim 4 wherein the upper surface of said first section and the under-surface of said second section are formed to be interlockable one with the other such that said second section is free to move only in a vertical direction relative to said first section.

8. The structure according to claim 4 wherein said first and second sections are releasably coupled by frangible means.

9. The structure according to claim 7 wherein seal means are included between said first and second sections, and between said second section and said column, and water extraction means are provided to effect removal of water from said open shaft.

10. The structure according to claim 2 wherein said column conjoins said platform and is supported thereby in a first floating mode, said platform including guide means adapted to operably receive said column and permit same to be lowered therethrough into engagement with said second section.

11. The structure according to claim 10 wherein a plurality of jacking devices facilitate motivation of said column with respect to said platform.

12. The structure according to claim 11 wherein said jacking devices are mounted on said platform about said column, each said jacking device being adapted for programmed releasable interengagement with said column to exert a motiving force thereto.

13. The structure according to claim 2 wherein said column and said second section are telescopically assembled, means being provided to affect vertical displacement of said column into engagement with said platform after said base section is located on the ocean floor and said second section is located on said first section.

14. The structure according to claim 10 or claim 13 wherein said support means further includes a plurality of ancillary jacking devices carried by said platform and adapted for releasable engagement with said second section to facilitate elevation of said platform to an operating height, said devices being thereafter retractable following operable interconnection of said column with said platform and said second section.

* * * * *